US007246464B2

(12) United States Patent
Castellon

(10) Patent No.: US 7,246,464 B2
(45) Date of Patent: Jul. 24, 2007

(54) DEVICE FOR THE LATERAL ADJUSTMENT OF A WINDOW REGULATOR FOR MOTOR VEHICLES OR SIMILAR

(76) Inventor: Melchor D. Castellon, Diputacion, 455-457, E-08013 Barcelona (ES)

( * ) Notice: Subject to any disclaimer, the term of this patent is extended or adjusted under 35 U.S.C. 154(b) by 201 days.

(21) Appl. No.: 10/482,965

(22) PCT Filed: May 6, 2003

(86) PCT No.: PCT/ES03/00199

§ 371 (c)(1),
(2), (4) Date: Jan. 7, 2004

(87) PCT Pub. No.: WO03/097976

PCT Pub. Date: Nov. 27, 2003

(65) Prior Publication Data

US 2004/0163319 A1 Aug. 26, 2004

(30) Foreign Application Priority Data

May 17, 2002 (ES) ..... 200201264 U

(51) Int. Cl.
*E05D 15/10* (2006.01)

(52) U.S. Cl. ..... 49/212

(58) Field of Classification Search ..... 49/212, 49/348, 349, 502

See application file for complete search history.

(56) References Cited

U.S. PATENT DOCUMENTS

| | | | | |
|---|---|---|---|---|
| 3,591,983 A | | 7/1971 | Hanson | |
| 4,589,227 A | | 5/1986 | Bickerstaff | |
| 4,956,942 A | * | 9/1990 | Lisak et al. | 49/502 |
| 5,927,021 A | * | 7/1999 | Kowalski et al. | 49/502 |
| 5,960,588 A | * | 10/1999 | Wurm et al. | 49/352 |

* cited by examiner

*Primary Examiner*—Jerry Redman
(74) *Attorney, Agent, or Firm*—Dickstein, Shapiro, LLP.

(57) ABSTRACT

The device includes a screw which turn allows adjusting the distance between the rail of a power window device and the inner portion of motor vehicle door and it is surrounded, at an end thereof, by a first adjusting through block formed integral to the door of the motor vehicle, and a second adjusting block for roughly adjusting or tightening the thread inwardly which is fixed to the power window device, the opposed end of said screw being threadingly received to the rail of the power window device. The device permits adjusting of the window pane in a very simple manner, with a highly reduced cost of production and with a considerably strong mechanism which, in turn, allows a fine adjustment of the lateral distance of the assembly of the power window device.

8 Claims, 1 Drawing Sheet

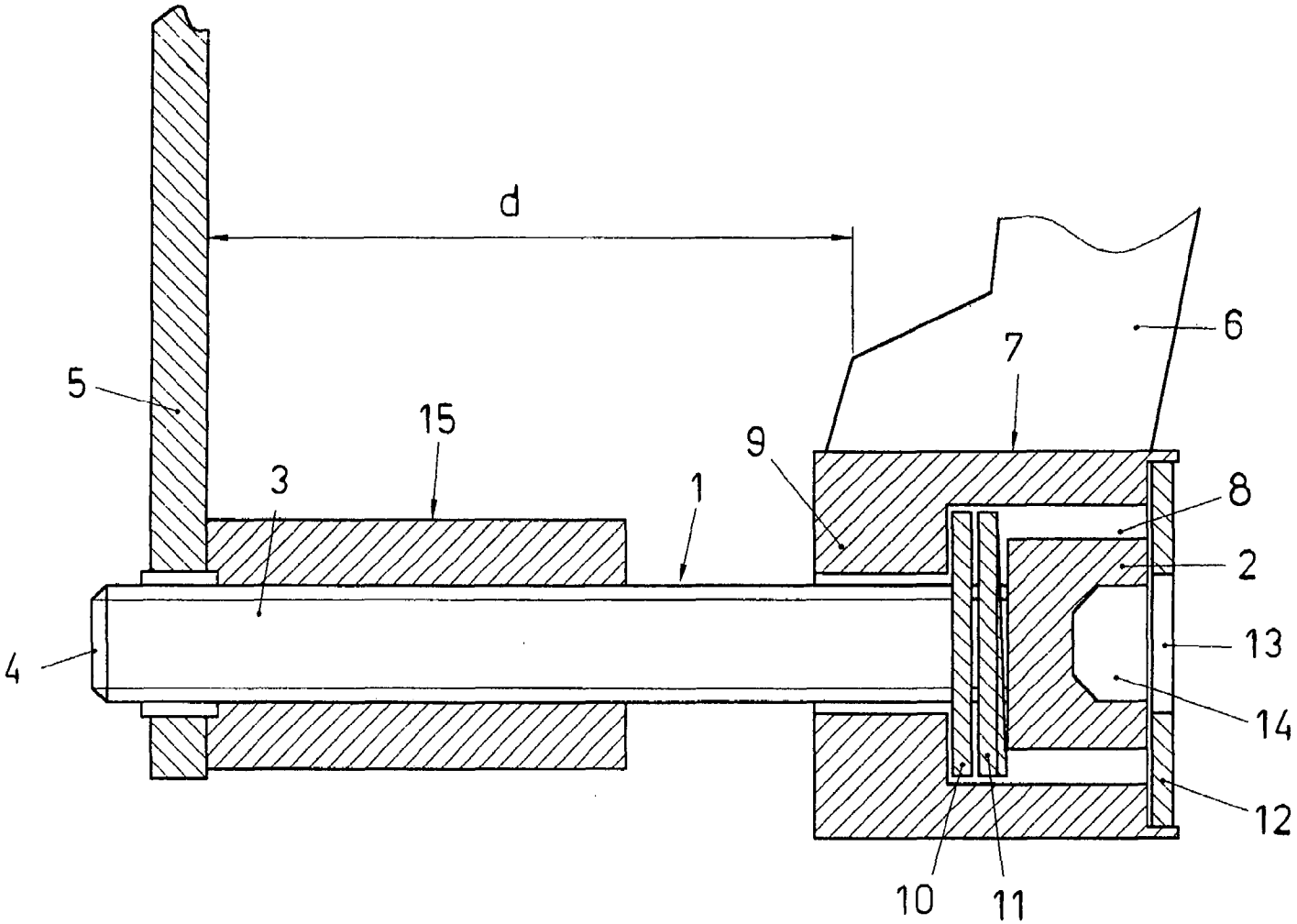
6
8
2
13
14
12
7
11
10
9
1
d
15
3
5
4

DEVICE FOR THE LATERAL ADJUSTMENT OF A WINDOW REGULATOR FOR MOTOR VEHICLES OR SIMILAR

BACKGROUND OF THE INVENTION

The power window devices of motor vehicles, whether they are manually or electrically driven, basically comprise a movable window pane, driving means for the window pane and gripping means therefor. The gripping means for the window pane includes at least a clamp which holds it by its lower edge and it is attached to a sliding member running through a guiding rail.

Both on the assembly process of the power window device and in operations of maintenance thereof it is important to be allowed to adjust the position of the window pane appropriately in the power window device with the purpose of correcting errors of distortions in the door of the vehicle and, in turn, to provide for the sealing conditions of the assembly.

Therefore, there exists a need for a capability of adjusting the power window device in a direction perpendicular to the axis of the door and for this purpose the present invention provides a device for lateral adjusting of a power window device of motor vehicles and the like.

SUMMARY OF THE INVENTION

There are other patents on devices for lateral adjusting of power window devices filed in the name of the same applicant. Among others, the common feature to these devices is essentially the provision of a screw which turn allows adjusting the distance between the rail of the power window device and the lower portion of the door.

In the present invention, said screw is surrounded, at an end thereof, by a first adjusting block which is inwardly threaded and formed integrally with the door of the vehicle, and a second adjusting block which is inwardly threaded and fixed to the power window device.

Preferably, the adjusting block has a first inner cylindrical portion and a second inner cylindrical portion of smaller diameter, said first inner cylindrical portion allowing the head of the screw to be received therein and said second inner cylindrical portion being a through portion.

The opposed end of said screw is threadably received to the rail of the power window device or to a plate welded thereto or to another plastic block.

Advantageously, the screw is provided with a flat washer and a spring washer adjacent to the head thereof inside of said first block. This set of washers allows carrying out a rough adjustment of the power window device, with no free play which adversely influences the accurate turn of the screw thus avoiding noise and vibrations.

According to the invention, said first block is provided with a cover having an access opening for the head of the screw which may be made either of plastic or metal.

The second block is such that screwing of the screw is a rough screwing with the purpose of keeping the position of the screw in the desired position, without coming loose as a result of vibrations and other movements of the door.

With a device as herein described it is possible to adjust the window pane of a motor vehicle in a very simple way, with a highly reduced cost of production and with a considerably strong mechanism which, in turn, allows a fine adjustment of the lateral distance of the assembly of the power window device.

BRIEF DESCRIPTION OF THE DRAWING

The features and the advantages of the device for lateral adjusting of a power window device for motor vehicles of the present invention will be apparent from the detailed description of a preferred embodiment which will be given hereinafter by way of a non limitative example with reference to the drawing that is herein accompanied, which corresponds to a longitudinal sectional view of an embodiment of a device for lateral adjusting a power window device for motor vehicles and the like according to the invention.

DESCRIPTION OF THE DRAWINGS

A detailed list of the various parts cited in the present patent application is given below:

(1) screw;
(2) head of the screw;
(3) stem of the screw;
(4) free end of the screw;
(5) rail of the power window device;
(6) door of the vehicle;
(7) first adjusting block;
(8) first inner cylindrical portion;
(9) second, not threaded, cylindrical through portion;
(10) flat washer;
(11) spring washer;
(12) cover of the first adjusting block;
(13) opening of the cover;
(14) cavity of the head of the screw;
(15) second adjusting block with rough thread; and
(d) distance between the power window device and the door of the vehicle.

In the device for lateral adjusting of a power window device for motor vehicles, which is shown in the figure herein enclosed, it may be appreciated how it is comprised by a screw generally indicated at (1). The screw has a head (2), for example a head of the so-called Allen type, and a stem (3) which free end (4) is screwed to the rail or support (5) of the power window device of the motor vehicle.

The screw (1) serves the purpose of adjusting the distance (d) between said rail (5) of the power window device and the inner portion of the door (6) of the motor vehicle.

As it can be seen, the screw (1) of the device that is herein described is surrounded by a first block (7), or adjusting block, formed integrally with the door (6) of the vehicle. Said adjusting block (7) has a first inner cylindrical portion (8) and a second inner cylindrical portion (9) of smaller diameter that said first inner cylindrical portion (8). The first inner cylindrical portion (8) allows the head (2) of the screw (1) and a set of washers consisting of a flat washer (10) and a spring washer (11) placed adjacent to the head (2) of the screw (1) to be received therein. As it can be seen from the figure, the second inner cylindrical portion (9) is a through portion and the first inner cylindrical portion (8) of the adjusting block (7) is provided with a cover (12) having an access opening (13) so that a tool may pass toward the cavity (14) of the head (2) of the screw (1). Both the adjusting block (7) and the cover (12) may be made either of metal or plastic.

The device that is herein described according to the invention is provided with a second adjusting block (15) mounted in the vicinity of the free end (4) of the screw (1). Said second adjusting block (15) is also inwardly threaded or otherwise it is provided with a nut inserted in such a way that tightening or rough screwing takes place and it is mounted secured to the rail (5) of the power window device or fixed to a plate welded thereto. This second adjusting block (15) allows a screwing displacement of the power window device relative to the assembly formed by the door (6) and the first block (7).

An accurate and simple adjusting means is obtained to adjust the position of the power window device in a direction perpendicular to the door of the vehicle where it is mounted.

Once having been sufficiently described what the present invention consists in accordance to the enclosed drawing, it is understood that any detail modification can be introduced as appropriate, provided that variations may alter the essence of the invention as summarised in the appended claims.

The invention claimed is:

1. Device for lateral adjusting a power window device, said lateral adjusting device comprising a screw (1) having first and second opposed ends with a shaft therebetween whose rotation adjusts the distance (d) between a rail and (5) a motor vehicle door (6), characterized in that said screw (1) is surrounded, at the first end thereof, by a first adjusting through block (7) formed integral to the door (6), and a second adjusting block (15) being fixed to the rail and having an internal threaded bore for receiving the shaft of the screw, the opposed second end (4) of said screw (1) being threadingly received in the rail (5), wherein the screw (1) is provided with a flat washer (10) and a spring washer (11) adjacent to a head (2) thereof inside of said first block (7).

2. Device for lateral adjusting a power window device according to claim 1, characterized in that said first block (7) is provided with a cover (12) having an opening (13) for the head (2) of the screw (1).

3. Device for lateral adjusting a rail of a power window device for motor vehicles, said lateral adjusting device comprising a screw (1) having first and second opposed ends with a shaft therebetween whose rotation adjusts the distance (d) between the rail (5) and a motor vehicle door (6), characterized in that said screw (1) is surrounded, at the first end thereof, by a first adjusting through block (7) formed integral to the door (6) and a second adjusting block (15) being fixed to the rail and having an internal threaded bore for receiving the shaft of the screw, the opposed second end (4) of said screw (1) being threadingly received in the rail (5), wherein the first block (7) has a first inner cylindrical portion (8) and a second inner cylindrical portion (9) of smaller diameter than the first inner cylindrical portion, said first inner cylindrical portion (8) allowing a head (2) of the screw (1) to be received, and said second inner cylindrical portion (9) allowing the shaft of the screw to be received.

4. Device for lateral adjusting a power window device according to claim 3, characterized in that said first block (7) is provided with a cover (12) having an opening (13) for the head (2) of the screw (1).

5. Device for lateral adjusting a power window device, said lateral adjusting device comprising a screw (1) having first and second opposed ends with a shaft therebetween whose rotation adjusts the distance (d) between a rail (5) and a motor vehicle door (6), characterized in that said screw (1) is surrounded, at the first end thereof by a first adjusting through block (7) formed integral to the door (6), and a second adjusting block (15) being fixed with the rail and having an internal threaded bore for receiving the shaft of the screw, the opposed second end (4) of said screw (1) being threadingly received in the rail (5), wherein the first block (7) has a first inner cylindrical portion (8) and a second inner cylindrical portion (9) of smaller diameter than the first inner cylindrical portion, said first inner cylindrical portion (8) allowing a head (2) of the screw (1) to be received, and said second inner cylindrical portion (9) allowing the shaft of the screw to be received, and wherein the screw (1) is provided with a flat washer (10) and a spring washer (11) adjacent to the head (2) thereof inside of said first block (7).

6. Device for lateral adjusting a power window device according to claim 5, characterized in that said first block (7) is provided with a cover (12) having an opening (13) for the head (2) of the screw (1).

7. Device for lateral adjusting a power window device according to claim 5, characterized in that the flat washer (10) and spring washer (11) are disposed in said first inner cylindrical portion (8).

8. Device for lateral adjusting a power window device according to claim 7, characterized in that said first block (7) is provided with a cover (12) having an opening (13) for the head (2) of the screw (1), and the head (2) of the screw (1) is gearlessly connected to the shaft of the screw (1).

* * * * *